US005234355A

United States Patent [19]

Sosinski et al.

[11] Patent Number: 5,234,355

[45] Date of Patent: Aug. 10, 1993

[54] PREMOLD FOR A TWIST LOCKING FEMALE CONNECTOR

[75] Inventors: Charles W. Sosinski, Brick Township, Ocean County; Donald C. Brown, Freehold; Suzanne V. Hickey, Brick, all of N.J.

[73] Assignee: Heyco Stamped Products, Inc., Toms River, N.J.

[21] Appl. No.: 944,468

[22] Filed: Sep. 11, 1992

[51] Int. Cl.[5] ..... H01R 13/00

[52] U.S. Cl. ..... 439/337; 439/647

[58] Field of Search ..... 439/337, 641, 644, 647, 439/704

[56] References Cited

U.S. PATENT DOCUMENTS

| | | | |
|---|---|---|---|
| 3,023,394 | 2/1962 | Hubbell | 439/674 |
| 3,945,708 | 3/1976 | Griffin | 439/337 |
| 4,173,383 | 1/1979 | Lee | 439/674 |
| 4,907,985 | 3/1990 | Johnsen | 439/369 |
| 4,983,131 | 1/1991 | Esteban et al. | 439/456 |

OTHER PUBLICATIONS

Device marked " WOODS" fiber disk.

Device marked "a lower case letter m and a small sigma" fiber disk.

Device marked "ELECTRICORD" fiber disk.

*Primary Examiner*—Joseph H. McGlynn

*Attorney, Agent, or Firm*—Auslander & Thomas

[57] ABSTRACT

A premold cap and core with its specific configuration saves labor and material in the making of heavy duty female connectors. The premold core and cap receive female receptacles that are crimped to lead cable. The premold then is cast into a female connector. The female receptacles are capped in place held in insets in the core. The cap is hollow and receives the core locking the female receptacles in place. The cap replaces the prior art fiber disk and presents polarized openings for polarized male pins with flag-like ends. The engaged male pins on a male connector are rotated so that the flag-like end are beneath the polarized openings and cannot be disengaged without rerotation of the connectors.

20 Claims, 5 Drawing Sheets

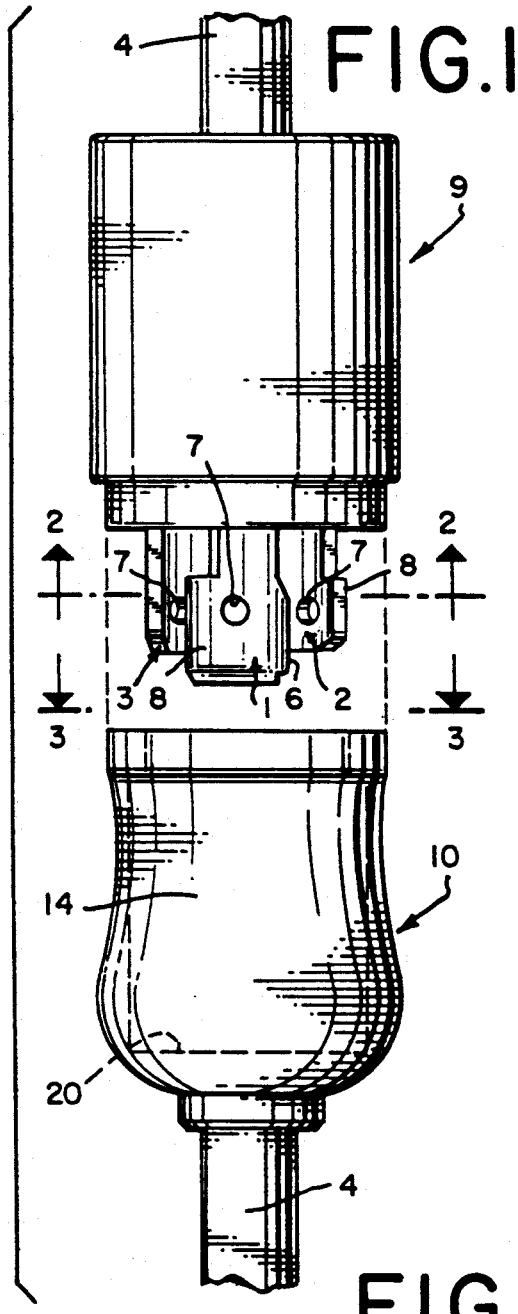
FIG.1
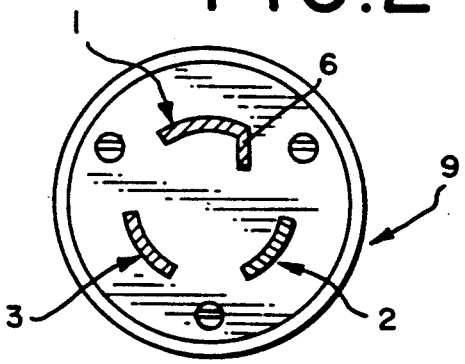
FIG.2
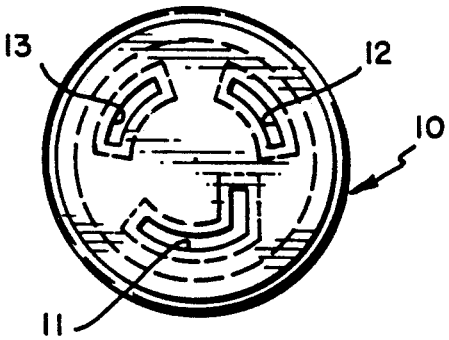
FIG.3
FIG.4
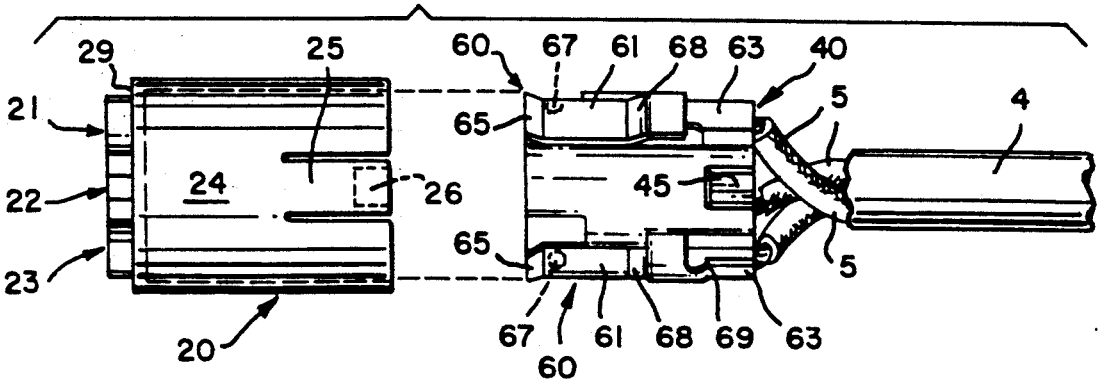

FIG.9
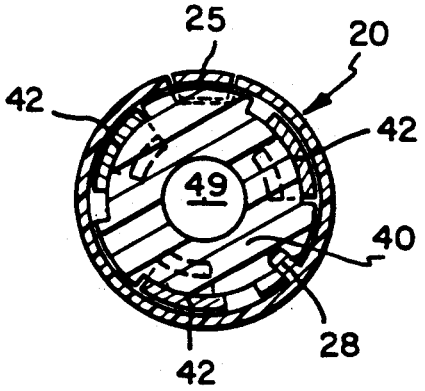
FIG.10
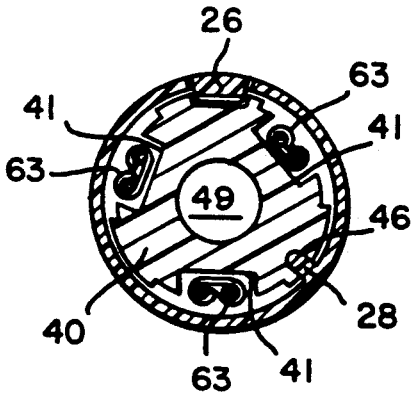
FIG.8
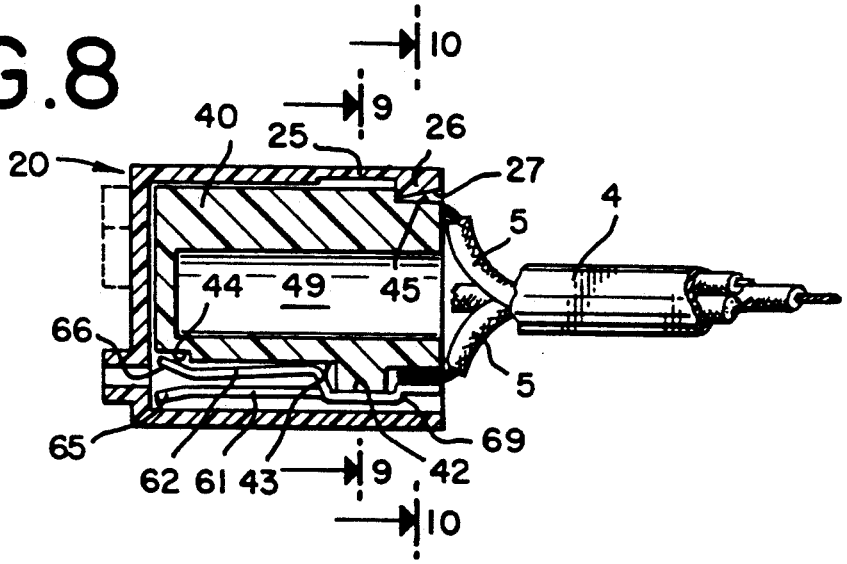
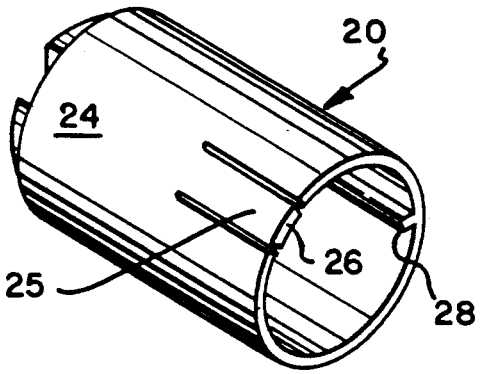
FIG.11

FIG.12
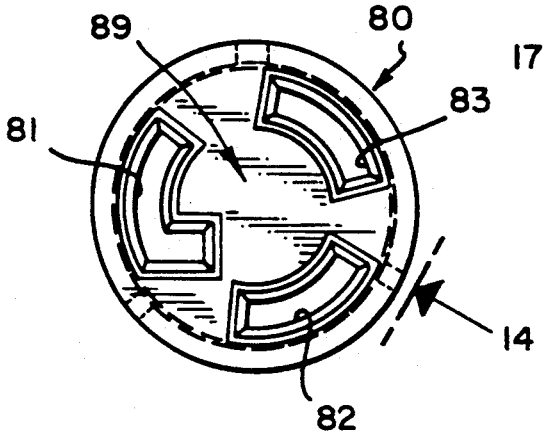
FIG.15
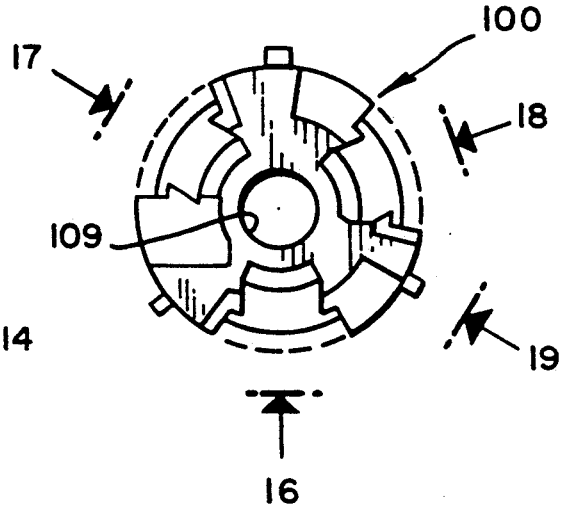
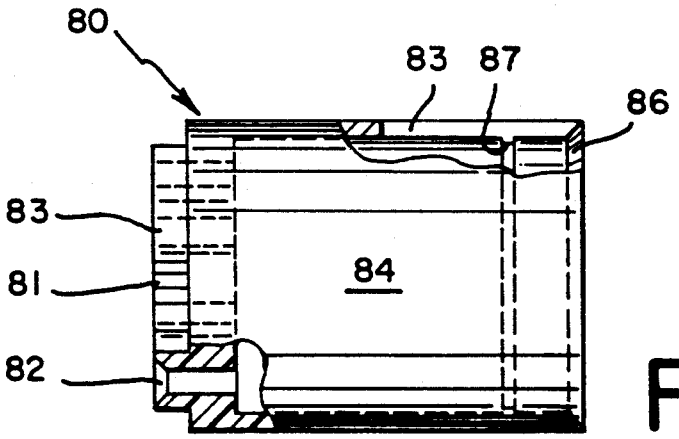
FIG.13
FIG.14
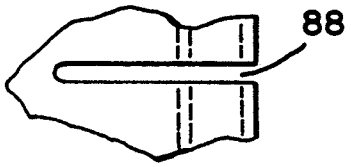

FIG. 16
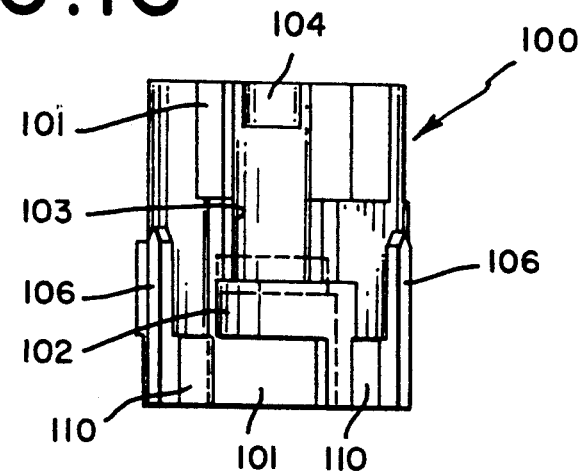
FIG. 17
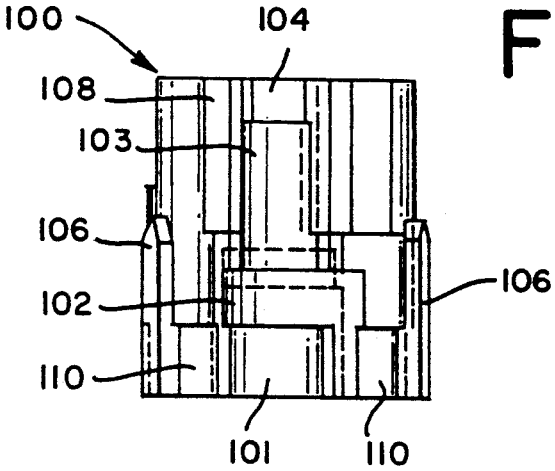
FIG. 19
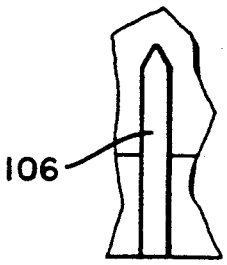
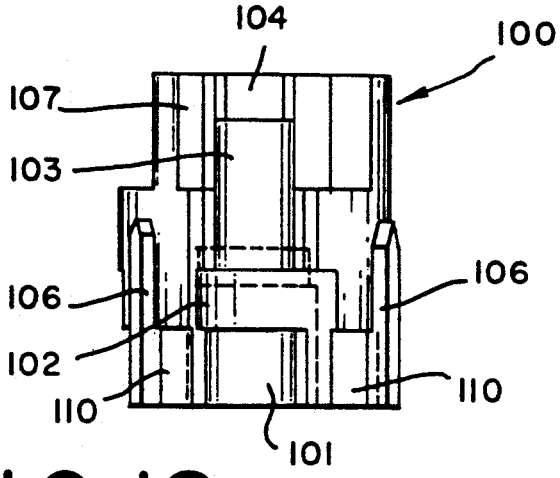
FIG. 18

PREMOLD FOR A TWIST LOCKING FEMALE CONNECTOR

BACKGROUND OF THE INVENTION

The present invention is a premold for a twist locking electrical female connector.

Heavy duty electrical cable, such as for plugging in of electricity for a trailer at a trailer camp, or machinery in a factory, or even a wall outlet have a three-prong polarized male connector. The male connector has a rounded male pin configuration having negative, positive and ground male pins. Each male pin is generally slightly differently configured so that the negative and positive male pins are different and polarized. The male ground pin has a right angulated flange. The male pins must be both rounded and polarized when plugged into the female receptacle. Once plugged in, connectors are rotated and locked. The locking provides engagement of flag like flange portions on all of the male pins.

The flag like portions engage the under portions of a fiber disk molded into the female connector. The fiber disk is referred to as fish paper. The fiber disk molded into a heavy female connector can withstand substantial strain. Without the fiber disk the male pins could work their way through the plastic of the female connector under stress and detach.

The rotated locked male pins in the female connector render the male and female connectors nondetachable without rerotation. The male pins each include openings which snap catch into dimples in the individual female receptacles. The dimples are a form of detent.

In the twist locking electrical female connector the female receptacles are usually identical and originate from a stamping strip. The female receptacles usually are machine crimped to the cords of the heavy duty electrical cable. The female receptacles each have a wide outer portion with a dimple for interlocking with the openings in the male pins. The female receptacles have narrow inner portions. The outer portions generally are of a width to usually at least contact most of the male pin after rotation.

The fiber disk is molded into the female connector. The fiber disk may have an opening in it for molding purposes or may be screw attached to the female connector through the opening before molding.

The female connector is bulky in order to have the strength necessary to protect the heavy duty electrical cable and because of the size of the heavy duty electrical cable.

Molding of the female connector is complex. Three crimped female receptacles have to be positioned in the mold for casting with the fiber disk. Mold bars may be used, or even cores used to which the fiber disk may be attached, and/or the crimped female receptacles held in the molding of the female connector.

The manufacture is complex, requires substantial labor, a large volume of plastic must be used in the molding and there is always the risk of wild strands.

DESCRIPTION OF THE RELATED ART

Annexed hereto is Form PTO-1449 and copies of the patents and prior art cited therein.

A typical prior art twist locking electrical female connector is molded, has a fiber disk internally molded and has identical female receptacles. The female receptacles have a wide outer portion and a narrow inner portion and dimples. It does not appear to be molded over a core. There is an opening in the fiber disk and an opening contiguous with the opening in the fiber disk in part of the inner female connector. It carries the trademark || |Wooods.

Another type of prior art female receptacle, is molded, has a fiber disk internally molded and has identical female receptacles. The fiber disk is screw fitted on to a core. The female receptacles are engaged in indentations in the core. The female receptacles are held in place by tape around the core. The female receptacles have a wide outer portion and a thin inner portion and dimples. It carries the trademark "a lower case letter m and a small sigma."

A typical prior art twist locking electrical female connector is molded, has a fiber disk internally molded and has identical female receptacles. The female receptacles have a wide outer portion and a narrow inner portion and dimples. It does not appear to be molded over a core. There is an opening in the fiber disk and no opening contiguous with the opening in the fiber disk in the inner female connector. It carries the trademark ELECTRICORD.

U.S. Pat. No. 3,945,708 discloses a female connector including a premold for emplacing female receptacles in separate compartments. The premold includes a snap in end cover to hold the female receptacles in the premold. The premold as disclosed replaces the prior art fiber disk.

U.S. Pat. No. 4,983,131 is exemplary of a premold configuration for male electric blades in a double molded configuration for a non-polarized outlet plug.

U.S. Pat. No. 4,907,985 is exemplary of a male and female mating ends for a pair of power extension cords, such as usable with the present invention. The connection pair is in triangular form, or may be semicircular or rectangular.

It is respectfully requested that this citation of art be made of record with regard to the within application.

SUMMARY OF THE INVENTION

The present invention is a premold core and cap to receive the crimped female receptacles to be capped in place and then molded into a female connector. The cap replaces the prior art fiber disk and presents polarized openings for polarized male pins with flag like ends. The engaged male pins on a male connector are rotated so that the flag-like end are beneath the polarized openings and cannot be disengaged without rerotation of the connectors.

A basic advantage of the present invention is the speed and economy of assembly of the core and female receptacles with the cap.

The prior art with regard to twist locking electrical female connector has employed cores and premold caps to replace the fiber disk. The present invention provides an interactive core and cap set for a twist locking electrical female connector. The cap is substantially hollow. The core has insets to receive the female receptacles and substantially fills the hollow of the cap.

The present invention eliminates prior art two piece load bars and facilitates the insertion of the female receptacles into the mold.

There is usually some form of polarizer, as between the cap and the core, thus precluding misassembly. The provision of a locking means, as between the cap and the core, helps prevent load and molding mishaps.

The nature of the cap precludes the danger of wild strands extending outside the body of the molded female connector.

The configuration of the extension on the openings in the cap may tend to eliminate material being injected into the female receptacles.

Molding can be prepared in a shorter time, using less molding material.

According to the present invention a premold for a heavy duty electrical female connector has a molded cap and a molded core for receptacles. The cap has a body, a hollow, a cover, and an opposite open end. The hollow extends substantially from inside the cover to the open end. There are male pin openings in the cover, at least one of which is polarized. The core has a length substantially equal to the length of the hollow and fits snugly in the hollow of the cover. The core has insets for supporting female receptacles snugly between the inner periphery of the hollow of the cover and in the core insets. The female receptacles have spaced apart inner and outer portions for receiving male pins with flag like projections. The core also has recesses for male pins when male pins are inserted through cover openings. The cover openings, female receptacles, and the male pins are all rounded and on a circular plane. The male pins are rotatable to engage their flag like portions beneath the cover.

The core insets may be rounded on a circular plane, and the cap and core may interlock such as with an interengagable finger and inset. The finger may be integral to the cap and the inset may be integral to the core. The finger may also have a latch with a ramp.

The interlock may also include a ridge to interengage the cap and the core and even a ridge inward of the cap at its open end. The ridge may be cambered and the core may be engaged by the ridge, there may be more than one spaced away ridge.

The cap and core may have interengable polarizers such as strips and slots.

The pin openings in the cover may have projections outlining the opening and may be shaped to receive a male pin polarizing flange. A recess in the core is shaped to receive a male pin polarizing flange. The core recesses may be rounded on a circular plane.

The female receptacle preferably have a wide outer portion and a narrow inner portion with the wide outer portion substantially the width of the male pin flag like projection.

Although such novel feature or features believed to be characteristic of the invention are pointed out in the claims, the invention and the manner in which it may be carried, may be further understood by reference to the description following and the accompanying drawing.

BRIEF DESCRIPTION OF THE DRAWING

FIG. 1 is a view of the twist locking electrical female connector of the present invention, exploded from a male connector.

FIG. 2 is a section view at lines 2—2 of FIG. 1 of the male connector, showing the male pins.

FIG. 3 is a plan view at lines 3—3 of FIG. 1 of the female connector, showing the pin openings.

FIG. 4 is a side elevation of the female receptacles over the core of the present invention, attached to heavy duty electrical cable and exploded from a cap of the present invention.

FIG. 8 is a side section elevation of the female receptacles in a capped core of the present invention, attached to heavy duty electrical cable.

FIG. 9 is a section view of FIG. 8 at lines 9—9.

FIG. 10 is a section view of FIG. 8 at lines 10—10.

FIG. 11 is an isometric view of the cap of FIG. 5 showing its open end.

FIG. 12 is a top plan view of another embodiment of a cap of the present invention.

FIG. 13 is a broken away side elevation of FIG. 12.

FIG. 14 is a detail of a polarizing slot in the cap at line 14 of FIG. 13.

FIG. 15 is a bottom plan view of another embodiment of a core of the present invention.

FIG. 16 is a front elevation of FIG. 15 at line 16.

FIG. 17 is a front elevation of FIG. 15 at line 17.

FIG. 18 is a front elevation of FIG. 15 at line 18.

FIG. 19 is a front elevation detail of FIG. 15 at line 19 showing a polarizing strip.

Referring now to the figures in greater detail, where like reference numbers denote like parts in the various figures.

DESCRIPTION OF THE PREFERRED EMBODIMENTS

Figure 5:
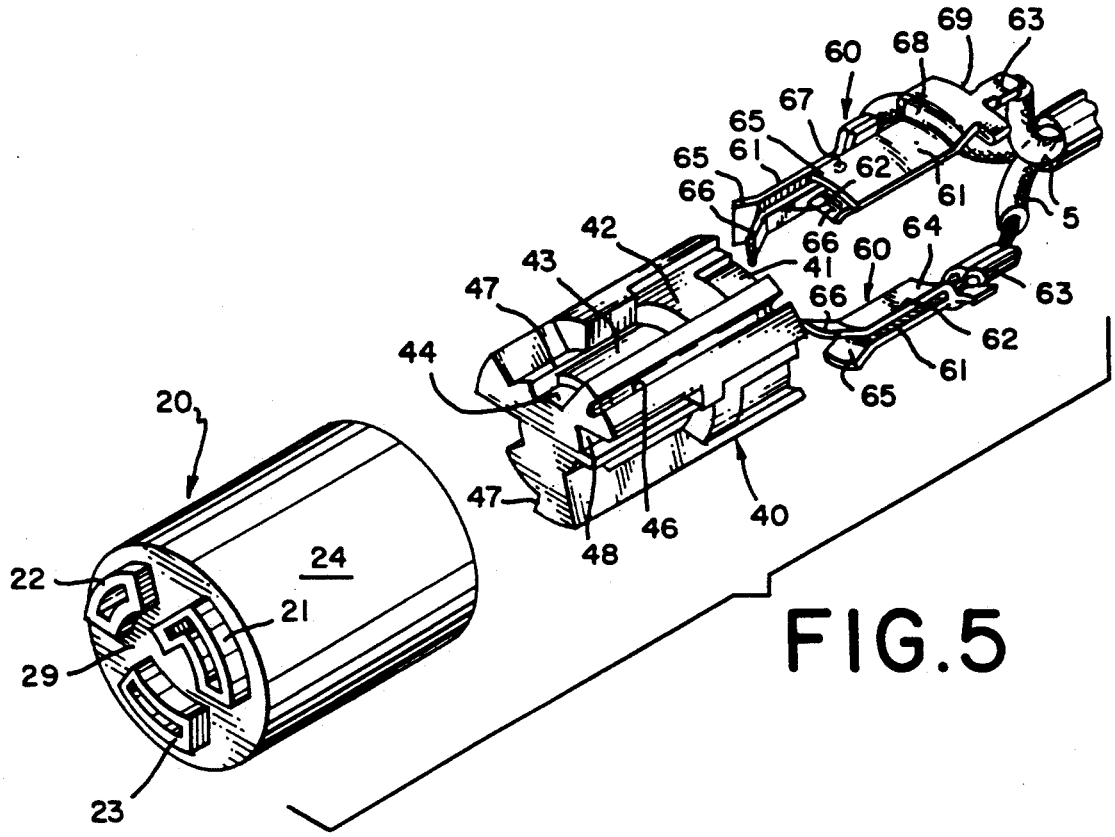
FIG. 5 is an exploded isometric view of FIG. 4 showing female receptacles attached to heavy duty electrical cable, exploded from the core and cap of the present invention.

In FIG. 1 a male connector 9 including male pins 1, 2, and 3 of the prior art is shown exploded away from a female connector 10 of the present invention. Both the male connector 9 and the female connector 10 have engaged heavy duty electrical cable 4. As can be seen in FIG. 3 the female connector 10 has openings 11, 12, and 13 for the male pins 1, 2, and 3.

Internal of the female connector 10, as shown in FIG. 4 is a premold cap 20 and premold core 40. Female receptacles 60 are crimped to the electric cords 5, from the electric cable 4. The female receptacles 60 are engaged in modular insets 41, 42, 43, and 44. The insets 41, 42, 43, and 44 can best be seen in FIG. 5.

The cap 20 has openings 21, 22 and 23. In the embodiment of the present invention as shown in FIGS. 1-11, only opening 21 is polarized since male pins 2 and 3 are the same shape. The body 24 of the cap 20 is cylindrical. The openings 21, 22 and 23 are in circular array inset from the circumference of the body 24 and protrude outward. A resilient finger 25 is cut out from the body 24. The finger 25 has a latch 26 with a ramp 27. There is a polarizing strip 28 inside the body 24, as shown in FIGS. 8-11.

The core 40 includes a latch inset 45 as can best be seen in FIG. 8 and a polarizing slot 46. There are modular male pin recesses 47 and 48 to receive the unrotated male pins 1, 2 and 3. Recesses 47 receive male pins 2 and 3 and recess 48 receives male pin 1 with its polarizing flange 6.

As can best be seen in FIGS. 5 the female receptacles 60 comprise a wide outer portion 61, a folded narrow inner portion 62 and a crimp end 63. The wide outer portion 61 and folded narrow inner portion 62 include offsets 68 and 64 and flares 65 and 66. The wide outer portion 61 includes a dimple 67.

The dimples 67 interact with openings 7 (see FIG. 1) in the male pins 1, 2 and 3 locking the male pins 1, 2 and 3 when they are rotated in the female connector 10. The flag like projections 8 also lock the male pins 1, 2 and 3 beneath the cover 29 of the cap 20 when the male pins 1, 2 and 3 are rotated in the female connector 10.

As can be seen in FIGS. 8, 9 and 10 the core 40 has a hollow 49.

In the embodiment of the present invention as shown in FIGS. 12-19, a cap 80 has openings 81, 82 and 83. Only opening 81 is polarized to accept male pins of the same shape. The body 84 of the cap 80 is cylindrical. The openings 81, 82 and 83 are in circular array inset from the circumference of the body 84 and protruding outward. Polarizing slots 88 are cut out, spaced about the body 84. The open end of the cap 80 has a small chamfered rim 86 about its circumference and a spaced away inwardly extending rounded ridge 87 about its circumference.

The core 100 includes polarizing strips 106 to interact with the polarizing slots 88. There are a modular male pin recesses 107 and 108 to receive unrotated male pins such as male pins 1, 2 and 3. Recess 107 receives male pins 2 and 3 and recess 108 receives male pin 1 with its polarizing flange 6.

As can be seen in FIG. 1, a male connector 9 with male pins 1, 2 and 3 is spaced away from a female connector 10. Males 2 and 3 are identical and have flag like projections 8. Male pin 1 has a flag like projection 8 and a polarizing flange 6.

Each of the pins include openings 7. The cross section of the pins can be seen in the top plan view of FIG. 2, where the pins are sectioned at lines 2—2 of FIG. 1.

The female connector 10, as shown in FIG. 1, has a molded body 14 with a cap 20 and core 40 molded within the body 14.

The male pins 1, 2 and 3 are connected to the cords 5 of heavy duty electric cable 4 by means not shown.

As can be seen in FIG. 4, the cords 5 are crimped to female receptacles 60, which are engaged on the core 40.

The cords 5 of the electric cable 4 are preferably color coded so that they can be matched to uniformly effect the necessary polarization, for at least as shown in the drawings, a ground pin and positive and negative pins. With this uniform color coding, input or outputs will always have their uniform polarity.

Insuring the polarity and positioning of the male pins 1, 2 and 3 are the polarized openings 11, 12 and 13, adapted to receive the male pins 1, 2 and 3.

As can be seen in FIG. 3, which is a top plan view of the female connector 10, the opening 11 has a configuration to receive the polarizing flange 6 of male pine 1, so that the female connector 10 and male connector, with the blades engaged, maintain the uniform polarity of the electric cords 5.

As can be seen in FIG. 4, the openings 21, 22 and 23 in the cap 20, project from the cover 29. The resilient finger 25 includes a latch 26, which is engagable in the latch inset 45 of the core 40. The openings 11, 12 and 13 coincide to the openings 21, 22 and 23 in the cap 20.

As can be seen in FIG. 4, the female receptacles are engaged in the insets 41-44 of the core 40. When the cap 20 has its polarizing strip 28 engaged with the polarizing slot 46 of the core 40, the cap 20 closes over the core 40, with the engaged female receptacles with the finger 25 latching in the latch inset 45. The resilient finger 25 allows the displacement of the finger 25 as the ramp 27 of the latch 26 rides over the core 40 until the latch 26 engages in the latch inset 45. As can be seen in FIG. 8, the polarized strip 28 can best be seen in the cap 20 in FIG. 1 and the polarizing slot 46 can best be seen in FIG. 5.

The receptacles 60 are engaged in the insets 41-44 in the core 40. As can be seen in FIG. 10, the crimp end 63 rests in the inset 41 while the folded wide outer portion 61 and the folded portion of the narrow inner portion 62 rests tightly in inset 42, as can be seen in FIG. 9. The narrow inner portion 62 rests in inset 43, as can be seen in FIG. 8 and the flare 66 of the narrow inner portion 62 rests in inset 44. The hollow 49 in the core 40 can be seen in FIGS. 8, 9 and 10.

Figure 7:
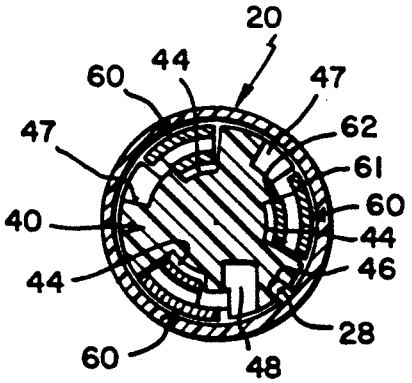
FIG. 7 top plan section through a capped core and the ends of engaged female receptacles.

As can be seen in section in FIG. 7, the core 40, with the female receptacles 60 in place, shows the recesses 47 adapted to receive the initially inserted blades 2 and 3 before rotation and the recess 48 adapted to receive the blade 1 with its polarized flange 6 before its rotation.

Figure 6:
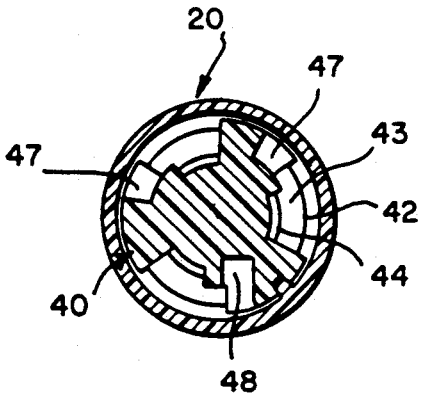
FIG. 6 top plan section below the cover of a capped core without female receptacles engaged.

In FIG. 6, the end of the core 40 can be seen engaged in the cap 20 without female receptacle 60 engaged.

OPERATION

As shown in FIGS. 1 through 11, a premold of the cap 20 and core 40 is fabricated by manually or automatedly, engaging the crimped female receptacle 60 within the recesses 41, 42, 43 and 44. The polarizing strip 28 of the cap 20 is then engaged in the polarizing slot 46 of the core 40. The ramp 27 of the latch 26 of the resilient finger 25 slides over the core 40 until it engages the inset 41, locking the cap 20, core 40 and crimp receptacle 60.

In this configuration, the premold may easily be molded into the female connector 10. The molding saves the labor of the more complicated assembly of the prior art. It is more quickly accomplished and requires less plastic than prior ar female connector assemblies. The female connector 10, when molded, has openings 11, 12 and 13, as shown in FIG. 3. The openings 11, 12 and 13 are contiguous with the projected openings 21, 22 and 23, extending from the cover 29 of the cap 20.

The cover 29 replaces the prior art fiber disk, while more simply providing the security against unwitting disengagement of locked male pins and eliminating any likelihood of the male connector 9 and female connector 10 being disengaged by the male pins working their way through the plastic of female connector 10.

The male pins, once engaged in the female connector 10, are rotatable, as in the prior art, engaging the flag like projections 8 between the female receptacle's 60 wide outer portion and narrow inner portion 61, while the flag like projections 8 are beneath the openings 21, 22 and 23 in the cover 29 of the cap 20, so that they cannot work apart until they have been rerotated. The dimples 67 for the male pins 1, 2 and 3, engage the openings 7 in the male pins to further nonrotation of the pins withdrawal position.

The cap 80 and core 100, as shown in FIGS. 12 through 19, function substantially similarly to the premold of the cap 20 and core 40.

The primary differences are that the cap 80 has three (only one shown) peripheral polarizing slots 88 engagable with the polarizing strips 106 on the core 100. The chamfered rim 86 resiliently guides the core 100 to pass into the cap 80 and engages the core 100 so that it cannot be dislodged. The rounded inwardly extending ridge 87 engages the female receptacle 60 below the base 69 formed by the fold of the wide outer portion 61 and the narrow inner portion 62 when female receptacles 60 is engaged in the insets 101, 102, 103 and 104 further stabilizing the engaged cap 80 and core 100. The core 100 may have a hollow 109, as shown in FIG. 15.

The folded wide outer portion 61 and the folded portion of the narrow inner portion 62 rest tightly in the inset 42, forming a dam against the entry of plastic molding material which might foul the female receptacles 60.

The polarizing slots 88 also serve an important function in rendering the body 84 flexible, so that the body 84 flexes as it engages the core 100, so as to easily override and engage the core 100.

The upper end of the core 100 may have a peripheral chamfered (not shown) for the easy entry of the core 100 into the cap 80. The extending ridge 87 also engages itself in the insets 110, firmly interlocking the core 100 and cap 80 and also acting as a dam against the inflow of plastic. The dam also includes the tight fitting folded portions of the outer wide portion 61 and the folded portion of the narrow inner portion 62, tightly engaged in the inset 42.

The polarized strips 106 facilitate assembly, since they are visible and can be felt by the operator and set, to visually, as well as tactilely interengage with the slots 88 for quick and effective assembly.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A premold for a heavy duty electrical female connector, said premold including a molded cap and a molded core to receive a plurality of female receptacles, said cap including a body, said body including a hollow; a cover; and an opposite open end, said hollow extending substantially from inside said cover to said open end, a plurality of male pin openings in said cover, at least one of said openings being polarized, said core having a length substantially equal to the length of said hollow, said core shaped to fit snugly in said hollow of said cover, said core including a plurality of insets for supporting said plurality of electric female receptacles snugly between the inner periphery of said hollow of said cover and in said core insets, said female receptacles including at least a spaced apart inner and outer portion for receiving a male pin therebetween, at least one male pin, at least one said male pin including a flag-like projection, said core further including at least one recess to receive said at least one male pin when said at least one male pin is inserted through a cover opening, at least said cover openings; said female receptacles; and said male pin all rounded on a circular plane, and said male pins rotatable to engage said at least one flag-like portion beneath said cover.

2. The invention of claim 1 wherein said core insets are rounded on a circular plane.

3. The invention of claim 1 wherein at least one said pin opening in said cover includes a projection substantially outlining said opening.

4. The invention of claim 1 wherein one said polarized openings in said cover is of a shape to receive a male pin polarizing flange.

5. The invention of claim 1 wherein one said recess in said core is of a shape to receive a male pin polarizing flange.

6. The invention of claim 1 wherein said core recesses are rounded on a circular plane.

7. The invention of claim 1 wherein said cap and core include interengable polarizing means.

8. The invention of claim 7 wherein said interengagable polarizing means include at least one polarizing strip and at least one polarizing slot.

9. The invention of claim 1 wherein said female receptacle includes a wide outer portion and a narrow inner portion.

10. The invention of claim 9 wherein said wide outer portion is substantially the width of said male pin flag like projection.

11. The invention of claim 1 wherein said cap and core include means to interlock.

12. The invention of claim 11 wherein said means to interlock includes ridge means to interengage said cap and said core.

13. The invention of claim 12 wherein said ridge means is cambered.

14. The invention of claim 12 wherein said means to interlock includes a ridge inward of said cap at said open end of said cap.

15. The invention of claim 14 wherein said core is engagable by said ridge.

16. The invention of claim 14 including at least one further spaced away ridge means.

17. The invention of claim 11 wherein said means to interlock include an interengagable finger and inset.

18. The invention of claim 17 wherein said finger is integral to said cap and said inset is integral to said core.

19. The invention of claim 18 wherein said finger includes a latch.

20. The invention of claim 19 wherein said latch includes a ramp.

* * * * *